US009004085B2

(12) United States Patent
Barwig et al.

(10) Patent No.: US 9,004,085 B2
(45) Date of Patent: Apr. 14, 2015

(54) DISHWASHING MACHINE

(75) Inventors: Alexander Barwig, Dillingen (DE); Bernd Heisele, Sontheim (DE); Norbert Näβler, Aulendorf (DE); Anton Oblinger, Gersthofen (DE); Karl Wirth, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1245 days.

(21) Appl. No.: 12/933,094

(22) PCT Filed: Mar. 27, 2009

(86) PCT No.: PCT/EP2009/053692

§ 371 (c)(1),
(2), (4) Date: Sep. 17, 2010

(87) PCT Pub. No.: WO2009/121816

PCT Pub. Date: Oct. 8, 2009

(65) Prior Publication Data

US 2011/0011430 A1 Jan. 20, 2011

(30) Foreign Application Priority Data

Mar. 31, 2008 (DE) ..... 10 2008 016 485

(51) Int. Cl.

| | |
|---|---|
| ***A47L 15/42*** | (2006.01) |
| ***A47L 15/50*** | (2006.01) |
| *A47L 15/23* | (2006.01) |

(52) U.S. Cl.

CPC ..... *A47L 15/508* (2013.01); *A47L 15/23* (2013.01); *A47L 15/504* (2013.01)

(58) Field of Classification Search

CPC ..... A47L 15/508; A47L 15/504; A47L 15/23
USPC ..... 134/56 D, 57 D, 58 D, 198
See application file for complete search history.

(56) References Cited

U.S. PATENT DOCUMENTS 3,734,589 A * 5/1973 Morgan ..... 312/351
4,064,887 A 12/1977 Geiger et al.

(Continued)

FOREIGN PATENT DOCUMENTS

DE 19926962 A1 12/1999
EP 1136030 B1 6/2009

(Continued)

OTHER PUBLICATIONS

Granting Decision RU 2010141484 dated Jun. 25, 2013.

*Primary Examiner* — Michael Kornakov
*Assistant Examiner* — Benjamin L Osterhout
(74) *Attorney, Agent, or Firm* — James E. Howard; Andre Pallapies

(57) ABSTRACT

A dishwashing machine including a dishwasher rack that assumes at least two different height positions; a spraying device to apply washing liquor to items to be washed, wherein the spraying device is assigned to the dishwasher rack; a hydraulic system to supply the spraying device with washing liquor; and a coupling with at least two openings to provide a liquid-conducting connection between the hydraulic system and the spraying device at the at least two different height positions and at at least two tilt positions. The at least two different height positions and the at least two tilt positions are assigned to at least one of the at least two openings to establish the liquid-conducting connection.

27 Claims, 3 Drawing Sheets

(56) References Cited

U.S. PATENT DOCUMENTS

| | | | | |
|---|---|---|---|---|
| 4,097,099 | A * | 6/1978 | Spiegel | 312/311 |
| 5,657,878 | A * | 8/1997 | Austin | 211/41.8 |
| 5,823,211 | A | 10/1998 | Wilhelmstatter et al. | |
| 7,410,228 | B2 * | 8/2008 | Dickson et al. | 312/311 |
| 2006/0119236 | A1 * | 6/2006 | Dickson et al. | 312/311 |
| 2006/0185700 | A1 | 8/2006 | Lee | |

FOREIGN PATENT DOCUMENTS

| | | | |
|---|---|---|---|
| FR | 2683444 | A1 | 1/1994 |
| WO | WO8301892 | A1 | 6/1983 |
| WO | WO2008029222 | A2 | 3/2008 |
| WO | WO2009027370 | A1 | 3/2009 |

* cited by examiner

DISHWASHING MACHINE

BACKGROUND OF THE INVENTION

The invention relates to a dishwashing machine.

Known from EP 1 136 030 A1 is a dishwashing machine having a washing compartment in which is disposed a pull-out dishwasher rack with which is associated a washing device for applying washing liquor to items to be washed. To facilitate ease of loading and unloading of the dishwasher rack, the dishwasher rack may be pulled out of the washing compartment with a coupling being provided to establish a liquid-conducting connection between the washing device associated with the pull-out dishwasher rack and a hydraulic system of the dishwashing machine, with which, during operation, the washing liquor can be conveyed by a circulating pump through pipes to the spraying devices. To this end, a coupling is provided which is disposed on a connection point on the rear wall of the washing compartment of the dishwashing machine and which opens when the dishwasher rack is pulled out and when the dishwasher rack is pushed back into the washing compartment establishes a liquid-conducting connection between the hydraulic system of the dishwashing machine and the washing device. To enable optimum utilization of the interior space of the washing compartment, the height of the dishwasher rack is adjustable, i.e. the clear height of the upper dishwasher rack in relation to the ceiling of the washing compartment can be adjusted like the clear height between an upper and a lower dishwasher rack so that it is also possible to place particularly large objects in the dishwasher racks. It is also provided that the dishwasher rack can adopt tilt positions with different height positions on both longitudinal sides of the dishwasher rack, namely one with a lowered right side and raised left side and one with a raised left side and lowered right side. For example, on the right side, the clear height for the upper dishwasher rack can be raised.

BRIEF SUMMARY OF THE INVENTION

The object of the invention is to provide a dishwashing machine with a dishwasher rack with further adaptation options.

The object of the invention is achieved by a dishwashing machine having at least one dishwasher rack that is able to adopt at least two different height positions, a spraying device for applying washing liquor to items to be washed, the spraying device being associated with the dishwasher rack, a hydraulic system for supplying the spraying device with washing liquor and a coupling with at least two openings for providing a liquid-conducting connection between the hydraulic system and the spraying device in the at least two different height positions and at least two tilt positions.

The achievement of the object of the invention is characterized in that one height position and at least two tilt positions are associated with at least one of the openings for establishing the liquid-conducting connection. Hence, it is achieved in a surprisingly simple way that tilt positions are possible in each of the selected height positions and therefore an operator is given many more options for adapting the interior space of a washing compartment to the requirements in question. This results in a particularly simple design since both a height position and a tilt position are assigned to at least one opening and so no additional openings are required to establish a liquid-conducting connection on the selection of a tilt position. Here, tilt position should be understood as meaning that a dishwasher rack is lowered or raised at a first side, for example the left side, while at the second side, for example the right side, the height position of the dishwasher rack is unchanged. In a second tilt position, on the other hand, the right side is lowered or raised while the left side of the dishwasher rack is unchanged. Therefore, two tilt positions should be understood to mean the alternative lowering or raising of a dishwasher rack on both sides from one height to another height.

In a preferred embodiment, it is provided that the coupling has three openings with which three height positions are associated. This provides a further increase in the possible variations and adaptations.

Preferably, it is provided that tilt positions are associated with at least two openings. This again increases the adaptability since tilt positions are possible via two differing height positions and also via three differing height positions without additional openings being required for this.

It is further preferably provided that an uneven number of tilt positions is associated with the two openings. This permits a particularly simple design in which tilt positions are associated with one opening via two differing height positions and also via three differing height positions, while tilt positions are associated with a second opening only via two differing height positions.

Hereby, the ratio of the number of the tilt positions is preferably one to two. However, other ratios of the number of tilt positions are also possible, such as, for example three to one.

Preferably, it is provided in a first embodiment that the hydraulic system has a dishwashing-machine-side connection point disposed on a rear wall facing the compartment opening of the washing compartment. Therefore, the washing compartment has a front-side compartment opening, which can usually be opened and closed with a pivot-mounted door attached to the washing compartment for loading and unloading the dishwashing machine. Hereby, the arrangement of the dishwashing-machine-side connection point on a rear wall of the washing compartment [facing] the compartment opening wall results in a particularly simple design in which the coupling is separated when, for example, the dishwasher rack is pulled out of the washing compartment of the dishwashing machine for unloading.

In a second, alternative embodiment, it is preferably provided that the hydraulic system has a dishwashing-machine-side connector disposed on a side wall connecting the compartment opening and the rear wall facing the compartment opening or disposed in a region between the rear wall and a side wall of a washing compartment of the dishwashing machine, i.e. in a corner area forming the transitional region between the rear wall and the side wall.

It is preferably provided that the connection point is disposed substantially centrally between side walls connecting the compartment opening and the rear wall, i.e., the connection point is substantially disposed on a vertically extending axis of symmetry of the washing compartment. This permits a particularly simple embodiment of the coupling.

It is preferably provided that the coupling has a dishwashing-machine-side section and a dishwasher-rack-side section. Hereby, connecting the two-part coupling to different height positions can enable the dishwasher rack to adopt different height positions with simultaneously a reliable supply of washing liquor to the spraying device associated with the dishwasher rack being guaranteed.

Preferably, it is provided that the dishwashing-machine-side section and the dishwasher-rack-side section are embodied adjustably in relation to each other about three axes at right angles to each other. A movement along a first axis enables the coupling to be opened and connected by pulling the dishwasher rack out or pushing it in. A movement along a second axis enables the height of the two sections to be adapted to each other when the height position of the dishwasher rack is changed. Hereby, the second axis extends in the perpendicular direction or gravity direction. A movement along a third axis enables the sections of the coupling to be adapted to each other on the selection of a tilt position of the dishwasher rack.

In a preferred embodiment, it is provided that a pivoting movement may be executed about at least one of the axes. This can be the movement along the third axis which enables the sections of the coupling to be adapted to each other on the selection of a tilt position.

Preferably, it is provided that the coupling has at least one liquid-conducting housing and a sealing element disposed in said housing. Hereby, the liquid-conducting housing establishes a liquid-conducting connection with the spraying device which is associated with the dishwasher rack and the sealing element disposed in the housing ensures that the spraying device is reliably supplied with washing liquor.

It is further preferably provided that the sealing element is pivot-mounted. Hereby, it is also preferably provided that the sealing element is disposed about an axis extending through the inlet. This enables the establishment of a reliable sealing connection between the dishwashing-machine-side section of the coupling and the spraying device associated with the dishwasher rack whatever the tilt position adopted by the dishwasher rack. Hereby, the symmetrical embodiment means that the pivoting angle required to achieve any tilt position of the dishwasher rack can be reduced so that the size of the liquid-conducting housing accommodating the sealing element is reduced. This permits a particularly compact design.

To limit the pivoting movement of the sealing element, stop means are also provided and these can be disposed on the housing.

In addition, it is preferably provided that the sealing element is disposed displaceably along an axis relative to the housing. Hereby, the axis can extend in the perpendicular direction so that the displacement of the sealing element relative to the housing against the gravity direction enables the sealing element to be positioned to establish a liquid-conducting connection.

In order to ensure the supply of washing liquor to the spraying device associated with the dishwasher rack, it is preferably provided that the sealing element has at least one inlet and at least two blanking plugs. Hereby, with a closed coupling, i.e. when both coupling parts are connected to each other, the inlet is connected to one of the openings and at least one of the blanking plugs closes off a further opening. In this way, it is guaranteed that washing liquor can flow through the inlet to the spraying device associated with the dishwasher rack through at least one of the two or three openings while the blanking plugs closes off the other openings. Hereby, the openings can be associated with the dishwashing-machine-side section of the coupling. This also has the advantage that, in all the height positions the dishwasher rack is able to adopt, there is no hydraulically unfavorable diversion of washing liquor at any height.

Preferably, the inlet is disposed centrally between the blanking plugs, i.e. the blanking plugs and the inlet are disposed in a row which substantially extends perpendicularly and the positions of the inlet and the blanking plugs correspond to the different height positions adoptable by the dishwasher rack, with the inlet being disposed in the center of this row adjoined by at least one of the blanking plugs.

In addition, it is preferably provided that the blanking plugs have inlet bevels. This facilitates the introduction of the blanking plugs into one of the openings in the different height positions of the dishwasher rack, when, for example, the dishwasher rack is pushed back into the dishwasher container. Alternatively, however, instead of inlet bevels, it is also possible to use other positioning means, which also guarantee reliable positioning.

Preferably, the blanking plugs are embodied as oblique circular cones, which preferably raise the sealing element against the force of gravity when the dishwasher rack is pushed in, i.e. when the blanking plugs come into contact with the openings, and so ensure automatic positioning. However, the circular cones can also have other, suitable forms.

BRIEF DESCRIPTION OF THE DRAWINGS

The following will now describe the invention with reference to the drawings, which show.

DETAILED DESCRIPTION OF EXEMPLARY EMBODIMENTS OF THE PRESENT INVENTION

Figure 5:
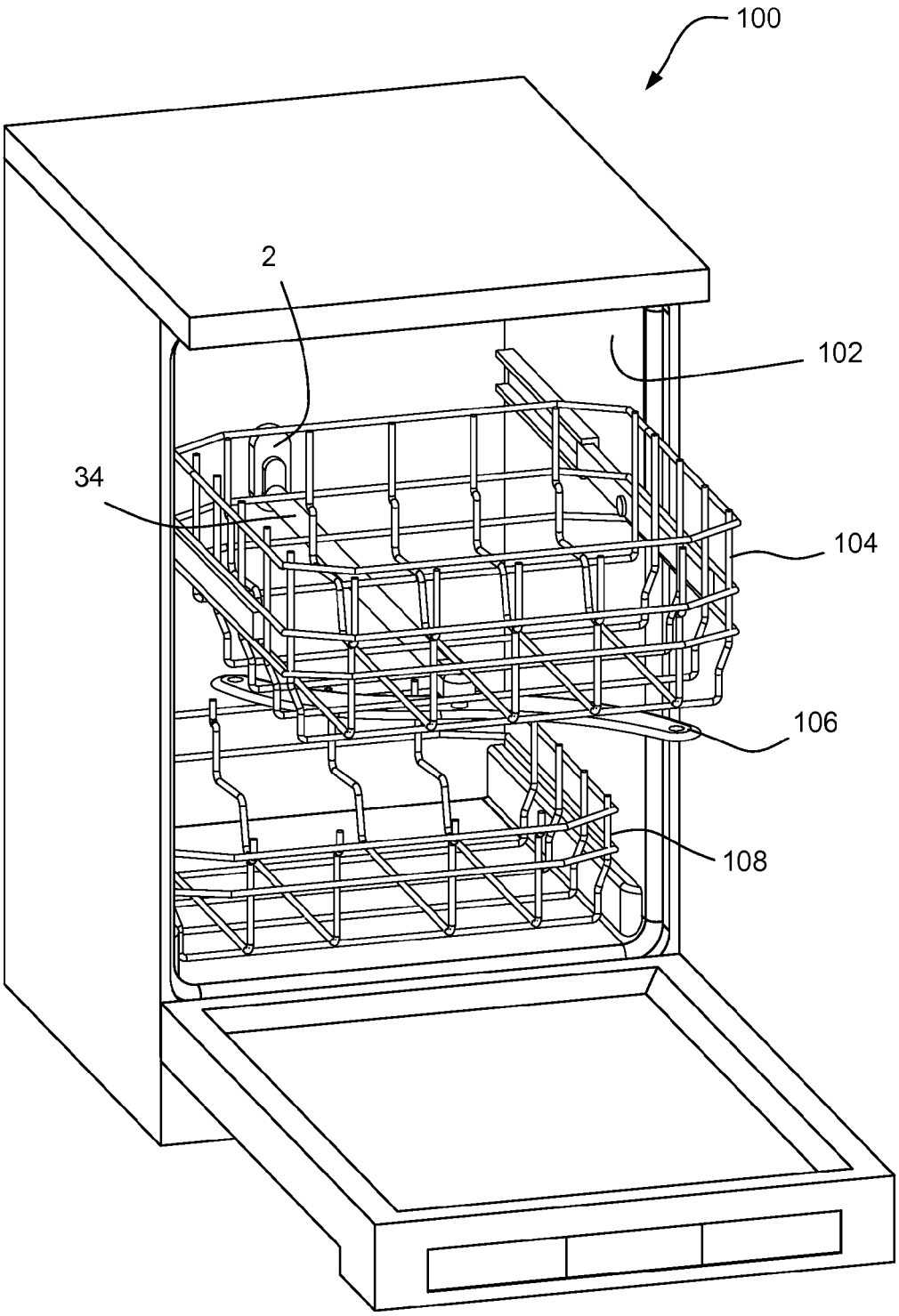
FIG. 5 is a perspective view of a dishwasher.

Reference is first made to FIG. 5.

A dishwashing machine 100 has a washing compartment 102 in which is disposed at least one dishwasher rack 104 which may be pulled out on two facing sides. Also provided is a height-adjustable mechanism (not shown) enabling the height of the dishwasher rack to be changed. Provided below the dishwasher rack, there is a spraying device 106 usually taking the form of a rotating spray arm.

Below this dishwasher rack, a further dishwasher rack 108 can be disposed in the washing compartment. In addition, a further receptacle embodied as a cutlery drawer can be provided above this dishwasher rack.

In order to supply the spraying device associated with the dishwasher rack in every height position, an inlet pipe 34 is provided which can be connected by means of a coupling 2 in different height positions to a hydraulic system of the dishwashing machine. Hereby, the hydraulic system has pipes, control means such as water dispensers and continuous flow heaters with which washing liquor can be circulated in washing mode. This means that the hydraulic system can supply washing liquor that accumulates on the floor of the washing compartment to the spraying device for application to the items to be washed with washing liquor.

To this end, the coupling 2 is formed from a dishwashing-machine-side section 14 and a dishwasher-rack-side section 16. Hereby, the coupling 2 is separable so that the pull-out dishwasher rack can be pulled out of the washing compartment of the dishwashing machine for loading and unloading wherein hereby the coupling 2 is open or separated. When it is subsequently pushed back into the washing compartment, the coupling 2 again establishes a liquid-conducting connection between the dishwasher-side section 14 and the dishwasher-rack-side section 16 so that, during the subsequent washing process, the hydraulic system can return washing liquor to the spraying device associated with the dishwasher rack.

To facilitate height adjustment, the dishwashing-machine-side section 14 has a coupling piece 36 of a feed pipe 32 with three openings 4, 6, 8 disposed centrally on the rear wall, i.e. the side facing the compartment opening of the washing compartment between side walls connecting the compartment opening and the rear wall. This means that the connection point 12 of the coupling 2 is disposed in the region of a vertically extending axis of symmetry of the washing compartment.

In addition to the inlet pipe 34, the dishwasher-rack-side section 16 of the coupling 2 has a housing 18 in which is disposed a sealing element 20. The sealing element 20 has an inlet 22 disposed along a line forming a liquid-conducting connection 10 with the inlet pipe 34 and four stub pipes 24, 26, 28, 30 disposed symmetrically above and below along a line to the inlet 22.

Figure 1:
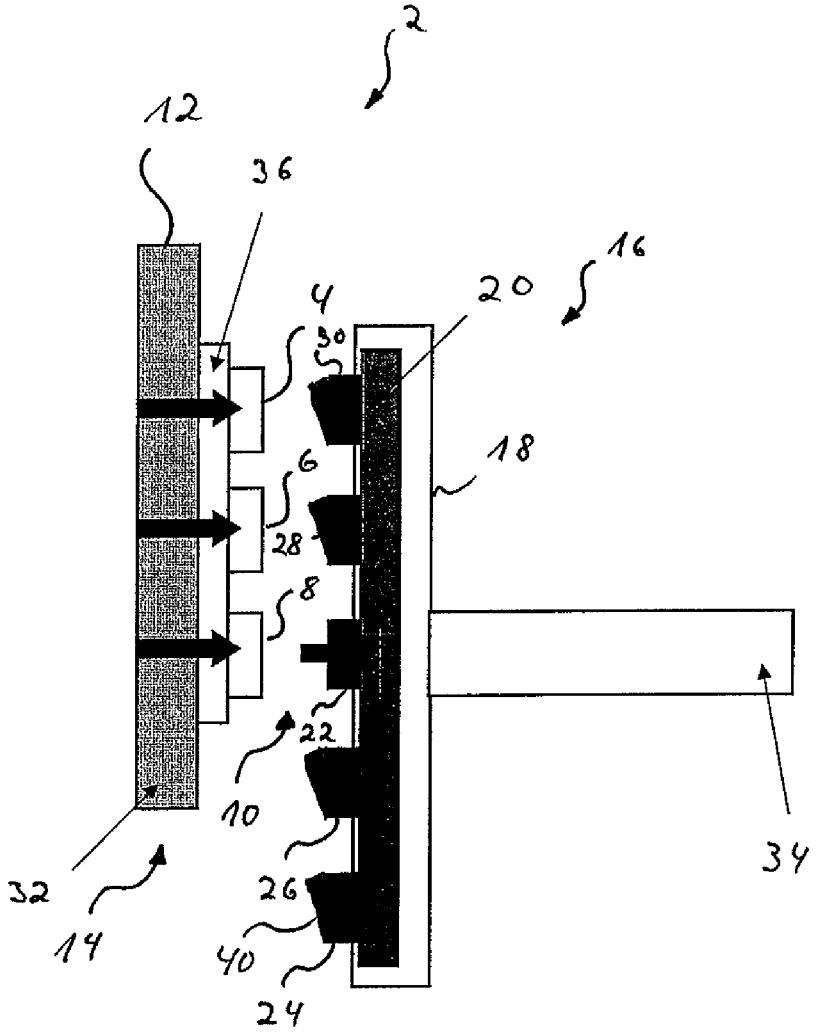
FIG. 1 a schematic representation of a coupling according to the invention
Figure 4:
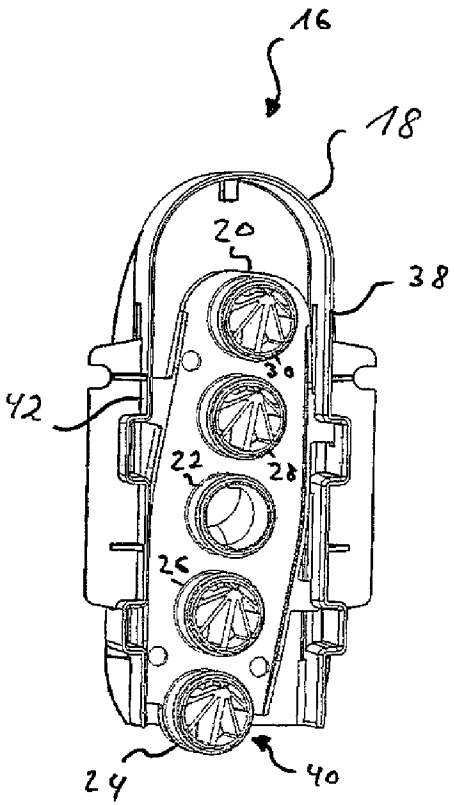
Figure 3:
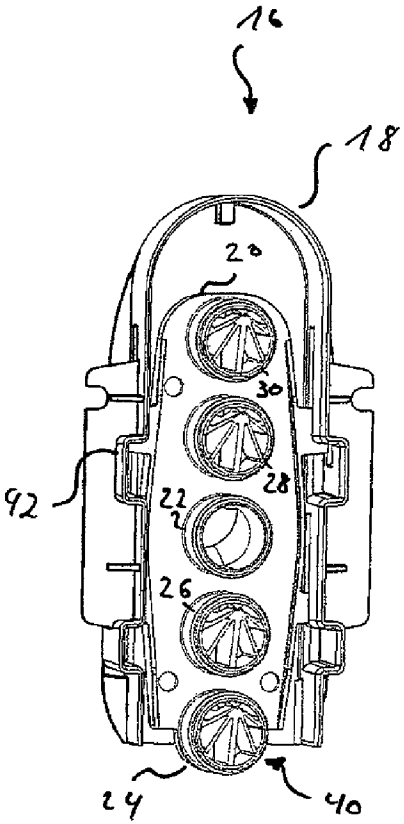
Figure 2:
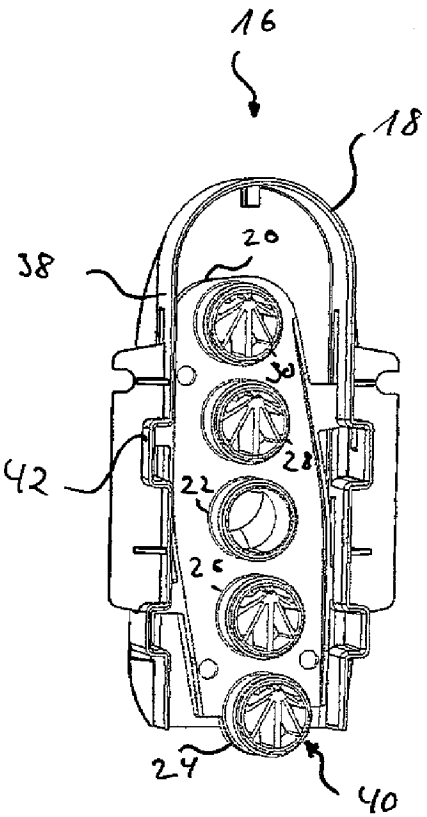
FIG. 2 a schematic representation of a liquid-conducting housing with a sealing element disposed therein in a first position, FIG. 3 the liquid-conducting housing with the sealing element with a second position, FIG. 4 the liquid-conducting housing with the sealing element in a third position.

Reference will now be made to FIGS. 2 to 4.

During the operation of the dishwashing machine, a desired height position is selected by an operator using the height-adjustable mechanism when the coupling 2 has been separated by pulling the dishwasher rack out of the washing compartment. When it is subsequently pushed back into the washing compartment, in the present exemplary embodiment, the inlet 22 and two of the blind stub pipes 24, 26, 28, 30 come into contact with the three openings 4, 6, 8 wherein the inlet 22 with the respective opening 4, 6, 8 forms a liquid-conducting connection 10 between the feed pipe 32 of the dishwashing-machine-side section 14 of the coupling 2 while the two other openings 4, 6, 8 are each sealed by two of the blind stub pipes 24, 26, 28, 30 and two further blind stub pipes 24, 26, 28, 30 do not seal any of the openings 4, 6, 8. In this way, the present coupling 2 permits a selection between three height positions of a dishwasher rack, an upper position, in which the inlet 22 is connected to the opening 4, a middle position, in which the inlet 22 is connected to the opening 6 and a lower position in which the inlet 22 is connected to the opening 8.

In addition, the coupling 2 also permits tilt positions of the dishwasher rack. A user can set a tilt position of the dishwasher rack by selecting different height positions at both sides of the dishwasher rack. Hereby, a tilt position is possible between the middle and the upper position with one of the two sides of the dishwasher rack being raised and the other being lowered. In addition, the tilt position is possible between the middle height position and the lower height position and between the upper and the lower height position of the dishwasher rack. This means that, in addition to the three height positions, six height positions can be selected in which the dishwasher rack is positioned obliquely.

When a tilt position of this kind is selected, the sealing element 20 is pivoted which to this end is disposed in a pivotable manner about an axis extending through the inlet 22 into the housing 18. In order hereby to achieve a reliable closure of the respective opening 4, 6, 8 by the respective blind stub pipes 24, 26, 28, 30, these are disposed symmetrically to inlet 22 and hence to the axis extending through the inlet 22. This means, when a tilt position of the dishwasher rack is selected, the housing 18 is pivoted while, due to its association with the dishwashing-machine-side section 14 of the dishwasher, the alignment of the sealing element 20 remains unchanged.

To facilitate the pivoting of element 20, longitudinal guides 42 are also provided, said longitudinal guides being formed by slots in the housing 18 into which tongues of the sealing element 20 engage. The movement of the sealing element 20 is limited by stop means 38 disposed in the housing 18. In addition, the sealing element 20 in the housing 18 can be disposed along an axis which, in installed condition, extends into a dishwashing machine in the perpendicular direction or gravity direction. In the present exemplary embodiment, the inlet 22 and the blanking plugs 24, 26, 28, 30 are disposed along this axis.

In order also to facilitate the introduction of the blanking plugs 24, 26, 28, 30 in oblique positions of the dishwasher rack when the coupling 2 is brought together again and to ensure automatic positioning of the sealing element 20, the blanking plugs are embodied as oblique circular cones, i.e. eccentrically. Hereby, due to their embodiment as eccentric circular cones, the blanking plugs 24, 26, 28, 30 have inlet bevels 40 which, on the bringing together of the coupling 2, effect a raising of the sealing element 20 against the force of gravity so that automatic positioning of the inlet 20 and the blanking plugs 24, 26, 28, 30 is guaranteed.

For example, each of the three height positions is associated with one of the openings 4, 6, 8. Four of the tilt positions are associated with the middle opening 6, namely two tilt positions between the lower and the middle height positions and two tilt positions between the lower and the upper height positions, while two tilt positions are associated with the upper opening 8, namely between the middle and upper height position.

Hence, a dishwashing machine with a dishwasher rack is provided with which the number of possible positions of the dishwasher rack is significantly increased and as a result offer much greater adaptability to a user's requirements.

LIST OF REFERENCE NUMBERS

2 Coupling
4 Opening
6 Opening
8 Opening
10 Liquid-conducting connection
12 Connection point
14 Dishwashing-machine-side section
16 Dishwasher-rack-side section
18 Housing
20 Sealing element
22 Inlet
24 Blanking plug
26 Blanking plug
28 Blanking plug
30 Blanking plug
32 Feed pipe
34 Inlet pipe
36 Coupling piece
38 Stop means
40 Inlet bevels

The invention claimed is:

1. A dishwashing machine, comprising:

a dishwasher rack that assumes at least two different height positions;

a spraying device to apply washing liquor to items to be washed, the spraying device being assigned to the dishwasher rack;

a hydraulic system to supply the spraying device with the washing liquor; and a coupling with at least two openings to provide a liquid-conducting connection between the hydraulic system and the spraying device at the at least two different height positions and to provide at least two tilt positions at each of the two different height positions;

wherein each of the two different height positions provides a different axis of rotation for the respective tilt positions.

2. The dishwashing machine of claim 1, wherein:

the dishwasher rack assumes at least three height positions, the coupling has three openings, and each of the three openings is assigned to a respective one of the three height positions.

3. The dishwashing machine of claim 2, wherein tilt positions are assigned to the at least two openings.

4. The dishwashing machine of claim 3, wherein an unequal number of the tilt positions is assigned between the at least two openings, respectively.

5. The dishwashing machine of claim 4, wherein a ratio of the number of the tilt positions assigned between the at least two openings is a ratio of one to two.

6. The dishwashing machine of claim 1, wherein the hydraulic system has a dishwashing-machine-side connector disposed on a rear wall of a washing compartment of the dishwashing machine, and wherein the rear wall faces an opening of the washing compartment.

7. The dishwashing machine of claim 6, wherein the dishwashing-machine-side connector is substantially centrally disposed between side walls connecting the opening of the washing compartment and the rear wall facing the opening of the washing compartment.

8. The dishwashing machine of claim 1, wherein the hydraulic system has a dishwashing-machine-side connector which is one of:

disposed on a side wall connecting a compartment opening and a rear wall facing the compartment opening; and disposed in a region between the rear wall and the side wall of a washing compartment of the dish washing machine.

9. The dishwashing machine of claim 1, wherein the coupling has a dishwashing-machine-side section and a dishwasher-rack-side section.

10. The dishwashing machine of claim 9, wherein, in relation to each other, the dishwashing-machine-side section and the dishwasher-rack-side section are adjustable about three axes arranged at right angles to each other.

11. The dishwashing machine according to claim 10, wherein a pivoting movement is executed about at least one of the three axes.

12. The dishwashing machine of claim 9, wherein the coupling has a liquid-conducting housing and a sealing element disposed in the liquid-conducting housing.

13. The dishwashing machine of claim 12, wherein the sealing element is pivot-mounted in the liquid-conducting housing.

14. The dishwashing machine of claim 12, wherein the sealing element is pivot-mounted about an axis that extends through an inlet.

15. The dishwashing machine of claim 12, wherein the liquid-conducting housing has a stop that limits pivoting movements of the sealing element.

16. The dishwashing machine of claim 12, wherein the sealing element is disposed displaceably along an axis in relation to the liquid-conducting housing.

17. The dishwashing machine of claim 12, wherein the sealing element has at least one inlet and at least two blanking plugs; wherein the inlet is connected to one of the at least two openings to establish the liquid-conducting connection; and wherein at least one of the two blanking plugs seals another one of the at least two openings.

18. The dishwashing machine of claim 17, wherein the inlet is disposed centrally between the blanking plugs.

19. The dishwashing machine of claim 17, wherein the blanking plugs have inlet bevels.

20. The dishwashing machine of claim 19, wherein, due to the configuration of the blanking plugs, the inlet bevels are oblique circular cones.

21. The dishwashing machine of claim 19, wherein, when the inlet bevels are in contact with the sealing element, the inlet bevels move the sealing element against the force of gravity.

22. A dishwashing machine comprising:

a dishwasher rack that is adjustable between at least two different heights and that is rotatable;

a spraying device associated with the dishwasher rack and adapted to spray washing liquor onto items to be washed;

a hydraulic system to supply the spraying device with the washing liquor; and a coupling device that connects the hydraulic system to the spraying device; wherein:

the coupling device provides at least two discrete fluid connections, one for each of the two different heights, and the coupling device defines an axis of rotation at each of the two discrete fluid connections about which the dishwasher rack rotates.

23. The dishwashing machine according to claim 22, wherein the coupling device comprises a first mating component and a second mating component that mate with one another, wherein:

the first mating component includes at least two first fluid connections, the second mating component includes one second fluid connection adapted to mate with either of the two first fluid connections, and the second mating component includes at least two plugs, one of which seals one of the two first fluid connections when the second fluid connection is connected to the other of the two first fluid connections.

24. The dishwashing machine according to claim 23, wherein the at least two plugs include oblique circular cones that compensate for misalignment when the first mating component and the second mating component are brought into engagement with one another.

25. The dishwashing machine according to claim 22, wherein the coupling device comprises a first mating component and a second mating component that mate with one another, wherein:

the first mating component includes at least three first fluid connections, the second mating component includes one second fluid connection adapted to mate with any of the three first fluid connections, and the second mating component includes at least four plugs, two of which seal two of the three first fluid connections when the second fluid connection is connected to the other of the three first fluid connections.

26. The dishwashing machine according to claim 22, wherein:

the coupling device comprises a first mating component and a second mating component that mate with one another, the second mating component includes a stationary component that is fixed with respect to the first mating component when the first component and the second component are mated with one another, and the second mating component includes a pivotable component that is pivotable with respect to the first mating component when the first component and the second component are mated with one another.

27. The dishwashing machine according to claim 26, wherein the pivotable component is pivotable about an axis parallel to an insertion and extraction direction of the dishwasher rack.

* * * * *